US005328298A

United States Patent [19]

Maffatone

[11] Patent Number: 5,328,298

[45] Date of Patent: Jul. 12, 1994

[54] SAFE ASCENT/DECOMPRESSION DEVICE

[76] Inventor: Anthony N. Maffatone, 68 Elizabeth St., Bloomingdale, N.J. 07043

[21] Appl. No.: 88,209

[22] Filed: Jul. 7, 1993

[51] Int. Cl.[5] ..... B63B 21/52

[52] U.S. Cl. ..... 405/185; 114/315

[58] Field of Search ..... 114/315; 441/23-26; 405/185, 186, 188

[56] References Cited

U.S. PATENT DOCUMENTS

| | | | |
|---|---|---|---|
| 3,543,526 | 12/1970 | O'Neill et al. | 405/185 X |
| 3,832,746 | 9/1974 | Korsgaard | 441/24 X |
| 4,040,135 | 8/1977 | Arnold | 441/26 X |
| 5,067,920 | 11/1991 | Brisky | 441/25 |
| 5,257,954 | 11/1993 | Mullisen et al. | 441/23 X |

FOREIGN PATENT DOCUMENTS

| | | | |
|---|---|---|---|
| 2746746 | 4/1978 | Fed. Rep. of Germany | 405/185 |
| 1093392 | 11/1967 | United Kingdom | 405/185 |

OTHER PUBLICATIONS

Gentile, Gary, (1989), *Andrea Doria: Dive to an Era*, Philadelphia, Pa.: Gary Gentile Productions, selected pages.

Gentile, Gary, (1992), *Ulimate Wreck Diving Guide*, Philadelphia, Pa.: Gary Gentile Productions, selected pages.

Gentile, Gary, (1988), *Advanced Wreck Diving Guide*, Centreville, Md.: Cornell Maritime Press, Inc., selected pages.

Gilliam, Bret & von Maier, Robert, *Deep Diving: An Advanced Guide to Physiology, Procedures and Systems*, San Diego: Watersport Publishing, Inc., selected pages.

*Primary Examiner*—Randolph A. Reese
*Assistant Examiner*—John A. Ricci
*Attorney, Agent, or Firm*—Klauber & Jackson

[57] ABSTRACT

An ascent/decompression device for use in diving with an inflatable lift bag, includes a pack for securing the ascent/decompression device on a diving harness worn by a diver; a reel mounted for rotation to the pack and having a decompression line wound thereabout, the decompression line being connected to the lift bag; a cable having a first end and a second loop end; a snap shackle connected with the first end and releasably holding the loop end to secure the cable about a ship wreck, the snap shackle including a main section having an open side, a closure lever pivotally connected to the main section for movement between closed and open positions, and a spring-biased pin for releasably locking the closure lever in the closed position; a first release clip for receiving the decompression line to limit a rate of ascent of the lift bag connected to the decompression line, and being connected to the cable; a second release clip secured to the pack for engaging with the spring-biased pin of the snap shackle; an ascender, connected to the pack, for grabbing onto and moving along the rope in only one direction; a spider for riding along a section of the decompression line extending between the lift bag when inflated and the reel, and for grabbing the ascender, the spider being connectable to a pull line for pulling the spider, and thereby the ascender, upwardly along the section of the decompression line.

18 Claims, 7 Drawing Sheets

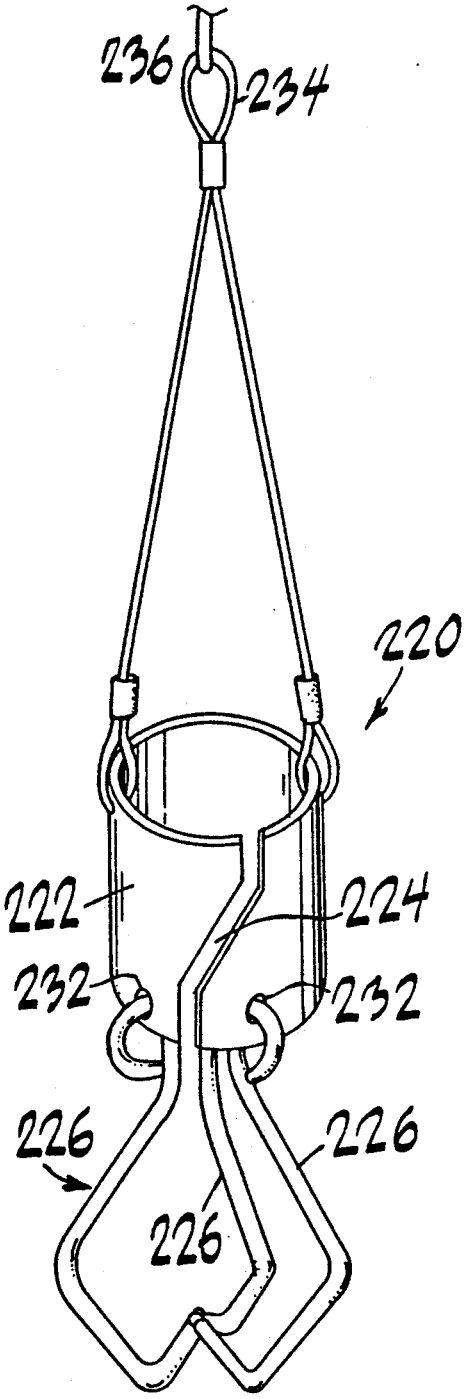
FIG. 7
FIG. 8
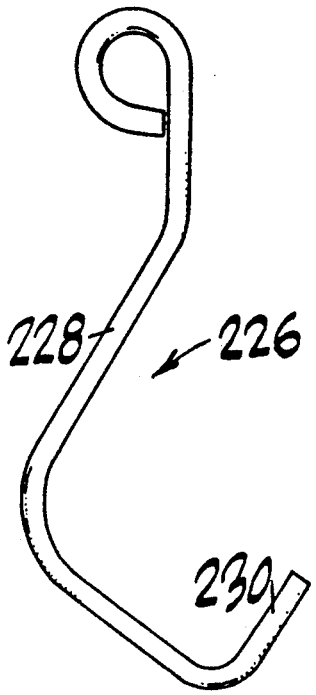
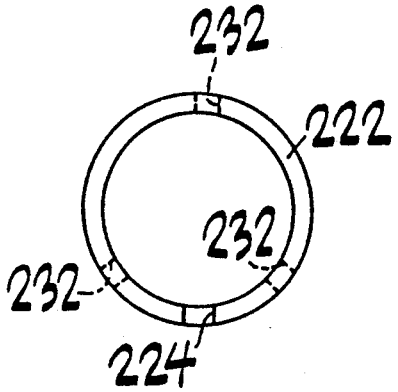
FIG. 9

SAFE ASCENT/DECOMPRESSION DEVICE

BACKGROUND OF THE INVENTION

The present invention relates generally to scuba diving, and more particularly, is directed to a device for providing safe ascent and decompression during dives. When returning to the surface from a deep water dive, it is necessary for the diver to decompress. To do so, the diver makes frequent stops on the way to the surface. Generally, the U.S. Navy Standard Air Decompression Table requires the diver to rise at a controlled rate of sixty feet per minute, while stopping at prescribed depths. This permits the nitrogen in the tissues of the diver to come out of solution and be expelled from the blood before expansion and before bubble formation constricts circulation. Otherwise, a situation known as the "bends" can occur, which can be deadly.

Because of the current in the water, if the diver merely ascends without any guide, the diver can find himself miles away from his boat. Accordingly, the diver will attempt to return to the surface along the anchor of the boat. However, frequently the anchor cannot be found, and the diver must return to the surface without the benefit of the anchor.

For this reason, a diver conventionally carries a decompression line in the form of a rope wrapped about a reel, the latter being held between the pair of oxygen tanks also supported on the diver's body. When the diver is ready to ascend, he ties an inflatable lift bag to the free end of the decompression line, and inflates the lift bag with oxygen from the tanks. The diver then holds onto the reel and permits the lift bag to rise to the surface, thereby paying out the rope from the reel. When the lift bag has reached the surface, the diver feels some slack in the line. Accordingly, the diver cuts the rope from the reel and ties the cut end of the rope to the ship wreck. Thereafter, the diver makes a planned ascent in order to properly decompress.

However, there are various problems that result from such an arrangement.

First, if many decompression lines are left in the water and tied to the ship wreck from many such decompression ascents, the water would be entangled with the lines, making it dangerous for future dives. Accordingly, the rope of the decompression line is made from hemp which decomposes over a period of time in the presence of salt water. In practice, a diver may carry the decompression line, while not using the same for many dives. For example, the diver may be able to use the anchor most of the time. However, after many dives, the diver may find himself in a predicament where he cannot find the anchor, and therefore, must use the decompression line. This, however, results in a problem. Specifically, since the decompression line has been subjected to salt water over many dives, it has at least partly decomposed and has therefore become weakened. As a result, the decompression line may break in use, which can be disastrous to the diver.

Second, because the decompression line is tied to the ship wreck, it cannot be retrieved. This adds to the cost of the dives, since the diver must periodically provide a new decompression line.

Third, before the diver releases the inflated lift bag, the diver must partially deflate his wet suit to eliminate some of his buoyancy, and thereby partially anchor himself to the ship wreck. Specifically, when the diver releases the inflated lift bag, the lift bag has a maximum rating for holding approximately 100 pounds of oxygen therein when inflated. However, if the diver were to inflate the lift bag to the full 100 pounds of pressure, even when partially anchoring himself, the large pressure in the lift bag would be too great for the diver, and the diver would be pulled upwardly. Accordingly, the lift bag is generally pressurized only to about 20 pounds. As a result, ascent of the lift bag is slower.

Fourth, and related to the third problem of inadequate inflation of the lift bag, the underinflated lift bag may not break through to the surface of the water, but rather, will generally remain a distance below the surface of the water. This is because the current will carry the underinflated bag after the opposite end of the decompression line is tied to the ship wreck, causing the lift bag to fall below the surface of the water. In such case, the lift bag will drift with the current somewhat and will therefore not provide a straight ascent for the diver. As a result, the diver, as he nears the position of the lift bag during ascent, must dart up the decompression line, further inflate the lift bag to full capacity and then dart back down the lift line to the previous decompression position. The diver will generally have about 60 seconds to perform this action before the adverse effects of a too quick decompression will affect him. This, of course, presents a dangerous situation to the diver.

Fifth, the decompression line and reel are relatively large and thereby carried on the back of the diver between the oxygen tanks. Because the decompression line is made from hemp, it must be relatively thick to provide sufficient strength, for example, on the order of one-quarter inch. This adds to the already approximately 200 pounds that the diver is carrying.

Sixth, the diver constantly bangs the tanks and the decompression line while swimming through the small openings in a ship wreck. As a result of these constant impacts and rubbing actions, the decompression line tends to become frayed, which can result in damage to the decompression line.

OBJECTS AND SUMMARY OF THE INVENTION

Accordingly, it is an object of the present invention to provide a safe ascent/decompression device that overcomes the problems with the aforementioned prior art.

It is another object of the present invention to provide a safe ascent/decompression device that can be easily retrieved after use.

It is still another object of the present invention to provide a safe ascent/decompression device that uses a stronger, lighter and thinner decompression line.

It is yet another object of the present invention to provide a safe ascent/decompression device that uses a decompression line that will not decompose in salt water.

It is a further object of the present invention to provide a safe ascent/decompression device with which the diver can inflate the lift bag to its full capacity at the start of the ascent operation.

It is a still further object of the present invention to provide a safe ascent/decompression device which does not require the diver to partially deflate his wet suit for buoyancy at the start of an ascent operation.

It is a yet further object of the present invention to provide a safe ascent/decompression device in which because of the smaller decompression line, the decompression line can be carried in a smaller area at the front of the diver's torso.

In accordance with an aspect of the present invention, an ascent/decompression device for use in diving with an inflatable lift bag, includes a pack for securing the ascent/decompression device on a diving harness worn by a diver; a reel having a decompression line wound thereabout, the reel being mounted for rotation to the pack, and the decompression line having a free end connected to the inflatable lift bag; a cable; a releasable cable securement device for releasably securing the cable about a ship wreck; a first release clip for receiving the decompression line and for limiting a rate of ascent of the lift bag connected to the decompression line, the first release clip being connected to the cable or the releasable cable securement device; and an ascender for grabbing onto and moving along the decompression line, the ascender including a direction limiter for limiting a direction of movement of the ascender along the decompression line, the ascender being connected to the pack or the harness.

The releasable cable securement device includes a release engagement device engageable with a portion of the decompression line such that a pulling force on the decompression line when the diver is at the surface of a body of water will cause the releasable cable securement device to release the cable from securement about the ship wreck in a first mode of operation of the ascent-/decompression device.

Specifically, the cable has a first end and a second end, with the second end formed into a loop, and the releasable cable securement device includes a snap shackle for releasably holding the loop. The snap shackle includes a main section having an open side and to which the first end of the cable is connected, a closure lever pivotally connected to the main section for movement between a closed position in closing relation to the open side and an open position which permits access to the open side, and a releasable locking device for releasably locking the closure lever in the closed position. The releasable locking device includes an inclined bore hole in a free end of the closure lever, a spring-biased pin in the main section for normally engaging within the inclined bore hole to lock the closure lever in the closed position, and a pull ring connected with the spring-biased pin for moving the spring-biased pin out of engagement with the inclined bore hole to permit pivoting of the closure lever to the open position, wherein the cable is formed into a closed configuration when the loop of the cable is releasably held within the snap shackle so that the cable can be releasably secured about the ship wreck.

A second release clip is provided for engaging with the pull ring of the releasable cable locking device in a second mode of operation, and a tying cable is provided for connecting the second release clip to the pack.

The first release clip is connected to the releasable cable securement device through a portion of the cable. The first release clip includes a main section having an open side, and a biased closure lever pivotally connected to the main section for movement between a closed position in closing relation to the open side and an open position which permits insertion and removal of the decompression line through the open side, the closure lever normally being biased into the closed position.

In addition, for use in the second mode of operation, a spider is provided for riding along a section of the decompression line extending between the lift bag when inflated and the reel, and for grabbing the ascender. A pull line is connected with the spider for pulling the ascender upwardly along the section of the decompression line. The spider includes a cylinder for receiving the decompression line therein and for riding along the section of the decompression line, the cylinder being connected with the pull line, and a plurality of hooks connected with the cylinder for grabbing the ascender. Further, the cylinder includes a slit along the entire length thereof for insertion of the decompression line into the cylinder.

In accordance with another aspect of the present invention, an ascent/decompression device for use in diving with an inflatable lift bag, includes a pack for securing the ascent/decompression device on a diving harness worn by a diver, the pack including clasps for releasably securing the pack to the diving harness worn by the diver; a reel having a decompression line wound thereabout, the reel being mounted for rotation to the pack, and the decompression line having a free end connected to the inflatable lift bag; a cable having a first end and a second end, with the second end formed into a loop; a releasable cable securement device for releasably securing the cable about a ship wreck, the releasable cable securement device including a snap shackle for releasably holding the loop of the cable, the snap shackle including a main section having an open side, a closure lever pivotally connected to the main section for movement between a closed position in closing relation to the open side and an open position which permits access to the open side, and a releasable locking device for releasably locking the closure lever in the closed position; a first release clip for receiving the decompression line and for limiting a rate of ascent of the lift bag connected to the decompression line, the first release clip being connected to the cable or the releasable cable securement device; a second release clip for engaging with the releasable locking device of the snap shackle, and a tying cable for connecting the second release clip to the pack; an ascender for grabbing onto and moving along the decompression line, the ascender including a direction limiter for limiting a direction of movement of the ascender along the decompression line, the ascender being connected to the pack; a spider for riding along a section of the decompression line extending between the lift bag when inflated and the reel, and for grabbing the ascender, the spider being connectable to a pull line for pulling the spider, and thereby the ascender, upwardly along the section of the decompression line.

The above and other objects, features and advantages of the invention will become readily apparent from the following detailed description thereof which is to be read in connection with the accompanying drawings.

BRIEF DESCRIPTION OF THE DRAWINGS

FIG. 7 is a perspective view of a spider device of the ascent/decompression device according to the present invention;

FIG. 8 is side elevational view of one grappling hook of the spider device of FIG. 7;

FIG. 9 is a top plan view of the cylinder of the spider device of FIG. 7;

DETAILED DESCRIPTION OF THE PREFERRED EMBODIMENTS

Figure 1:
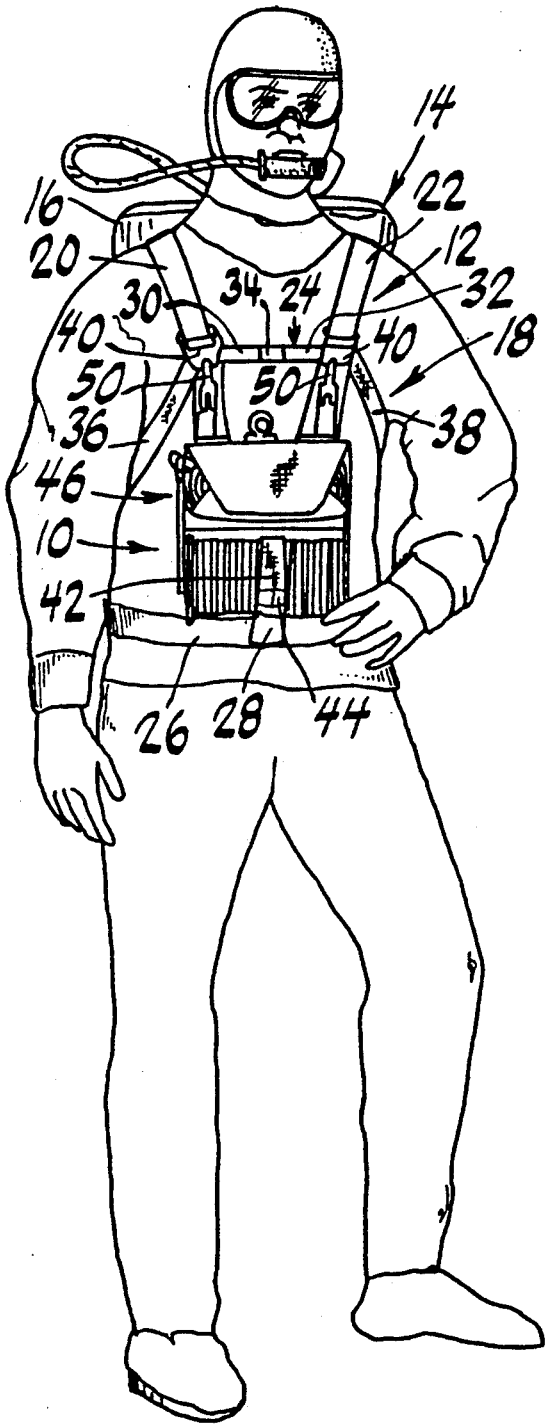
FIG. 1 is a perspective view of a safe ascent/decompression device according to the present invention, shown being worn by a diver.
Figure 3:
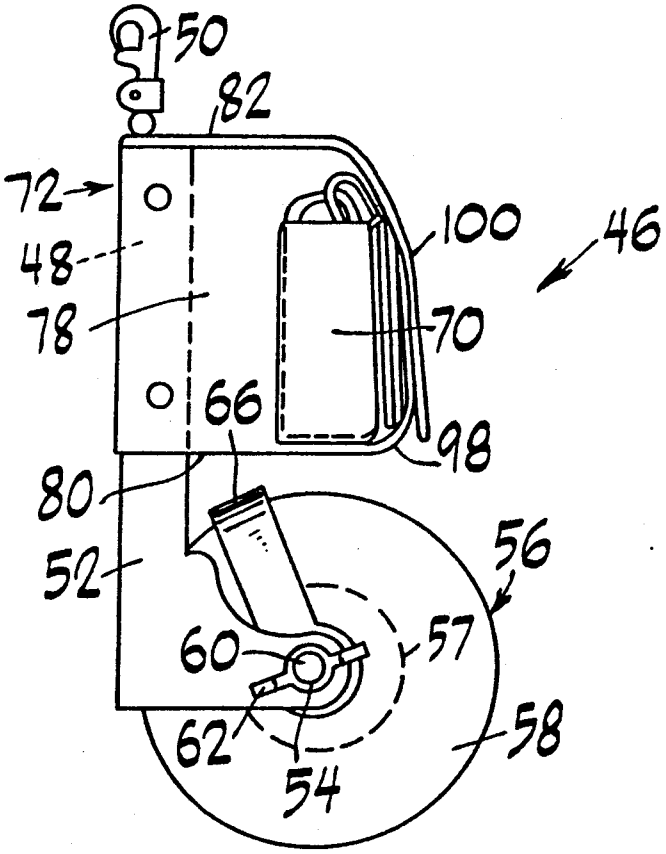
FIG. 3 is a side elevational view of the safe ascent-/decompression device of FIG. 1.
Figure 2:
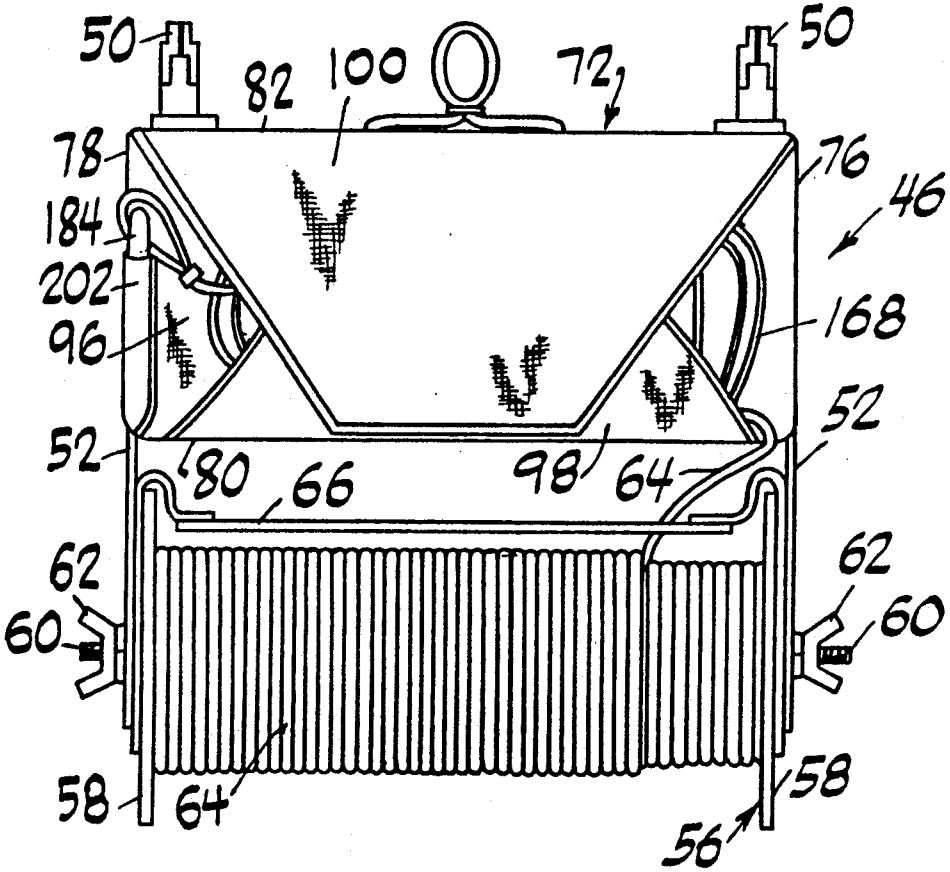
FIG. 2 is a front plan view of the safe ascent/decompression device of FIG. 1.
Figure 4:
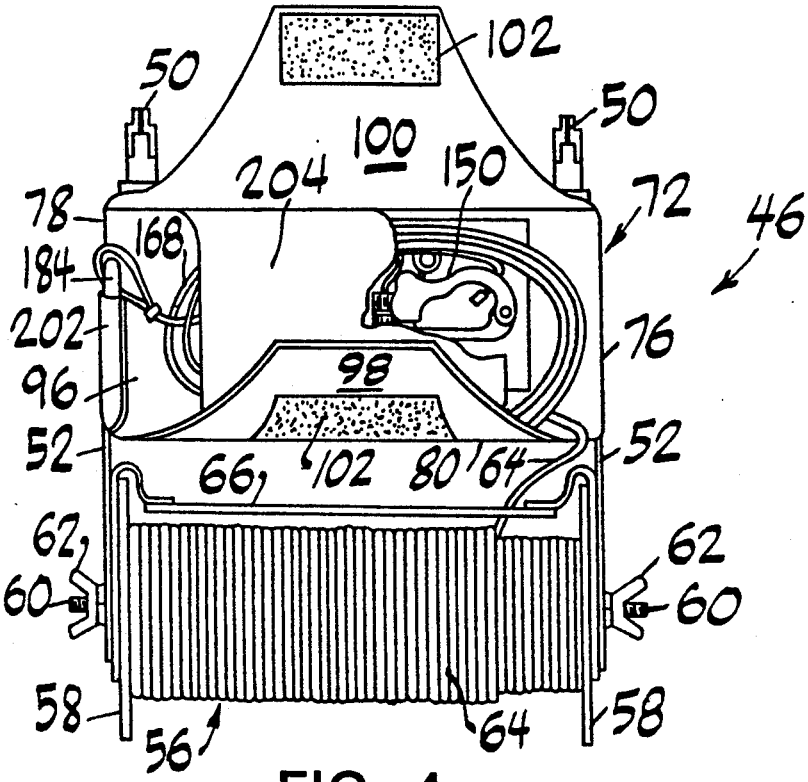
FIG. 4 is a front elevational view of the safe ascent-/decompression device of FIG. 2, in a partially opened configuration.
Figure 5:
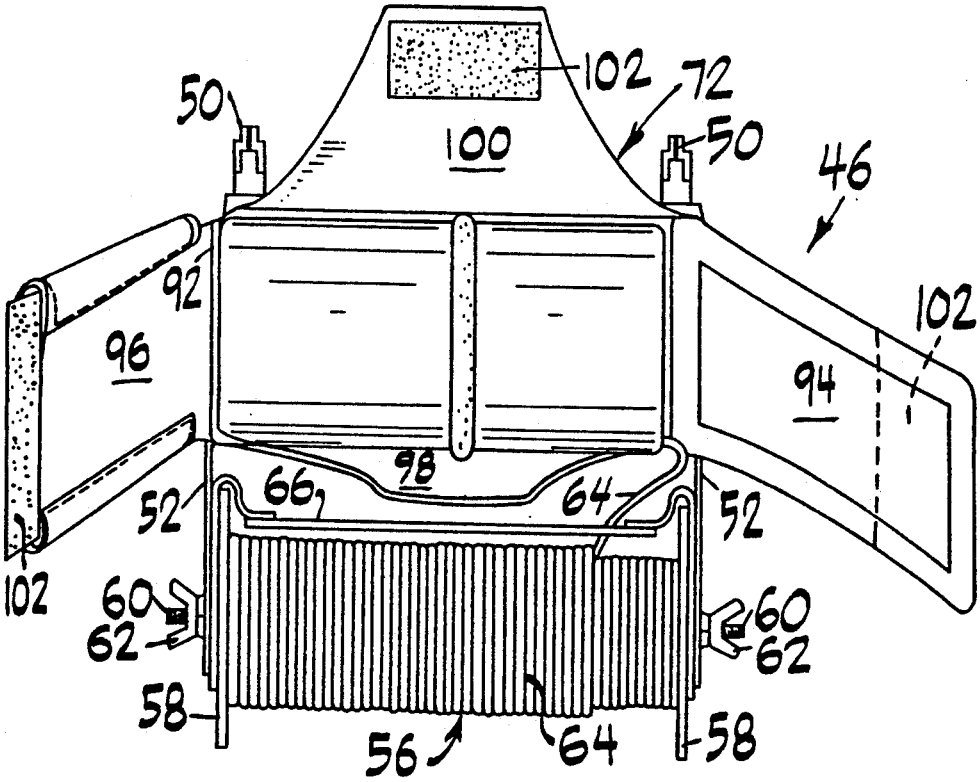
FIG. 5 is a front elevational view of the safe ascent-/decompression device of FIG. 2, in a further partially opened configuration.

Referring to the drawings in detail, and initially to FIG. 1, a safe ascent/decompression device 10 according to the present invention is removably attached to a diving harness 12 worn by the diver.

Diving harness 12 can be a conventional diving harness. In the embodiment shown, diving harness 12 includes a tank holding device 14 intended to be positioned at the rear of the torso of the diver when harness 12 is worn by the diver, for holding one or more oxygen tanks (not shown). Although not shown in detail, such tank holding device 14 preferably includes a metal plate 16, as is conventional. A plurality of straps 18 are secured to tank holding device 14, and are used to secure diving harness 12 and tank holding device 14 thereof on the torso of the diver.

Preferably, the plurality of straps 18 include opposite shoulder straps 20 and 22, an upper torso strap 24, a waist securing strap 26 and a mid-torso strap (not shown).

Specifically, each shoulder strap 20 and 22 includes one end connected to the opposite upper ends of metal plate 16 of tank holding device 14, with the opposite ends of shoulder straps 20 and 22 hanging down over the front of the torso of the diver and extending to the waist area of the diver. Waist securing strap 26 is connected to the lower end of metal plate 16 of tank holding device 14 and has opposite free ends that extend around the front of the waist of the diver. A quick release buckle 28 is secured to one free end of waist securing strap 26 to secure the free ends together and thereby secure waist securing strap 26 about the waist of the diver. Quick release buckle 28 can be any suitable mechanism, for example, similar to ones found in the seat buckles of automobiles. Further, the lower free ends of shoulder straps 20 and 22 are connected, for example, by sewing, to the respective free ends of waist securing strap 26.

Upper torso strap 24 releasably connects shoulder straps 20 and 22 together at the front of the upper torso of the diver. In this regard, upper torso strap 24 is formed by a first strap 30 connected to shoulder strap 20 at the front of the upper torso of the diver and a second strap 32 connected to shoulder strap 22 at the front of the upper torso of the diver. The free ends of straps 30 and 32 face each other and have a quick release connector 34 for securing the free ends together. Quick release connector 34 can be any conventional quick release coupling device, for example, of the type conventionally found on back packs, belly bags, and the like.

The mid-torso strap (not shown) is identical to upper torso strap 24 and is connected between shoulder straps 20 and 22, substantially midway between upper torso strap 24 and waist securing strap 26. The mid-torso strap is behind safe ascent/decompression device 10 in FIG. 1, and therefore, cannot be seen.

Finally, stabilizing straps 36 and 38 have one end connected to the juncture of straps 30 and 32 with shoulder straps 20 and 22, respectively. The opposite ends of stabilizing straps 36 and 38 are connected to the respective lower ends of metal plate 16.

By means of quick release buckle 28 associated with waist securing strap 26, quick release connector 34 associated with upper torso strap 24 and the quick release connector (not shown) associated with the mid-torso strap (not shown), diving harness 12 can be removably secured on the torso of the diver.

In addition, eyelets 40 are provided at different heights on the front of shoulder straps 20 and 22, and a short strap 42 is secured substantially perpendicularly to quick release buckle 28 so as to extend from opposite sides of buckle 28. A releasable securing and tightening mechanism 44, of a conventional nature, is secured to one free end of short strap 42. As will be described hereinafter, eyelets 40 and short strap 42 are used to releasably secure safe ascent/decompression device 10 to diving harness 12.

As shown in FIGS. 2-6, safe ascent/decompression device 10 includes a bag pack 46 having a rigid, substantially rectangular back frame 48 (FIG. 6) which may be made of a metal, plastic or other durable material. Release clasps 50 are pivotally secured to the upper edge at opposite sides of back frame 48, and are adapted to releasably catch onto respective eyelets 40 of opposite shoulder straps 20 and 22, so as to hang in front of the torso of the diver, at a desired height.

Substantially L-shaped reel brackets 52 are fixedly secured by welding or the like to the lower edge at opposite sides of back frame 48, so as to project slightly forwardly of back frame 48, and thereby, forwardly of the lower torso of the diver when safe ascent/decompression device 10 is connected to diving harness 12. The free ends of reel brackets 52 have aligned holes 54 therein. A reel 56 formed of a central hub 57 and circular end flanges 58 connected to opposite sides of central hub 57, is rotatably mounted to and between reel brackets 52. In this regard, reel 56 has opposite axially aligned, threaded spindles 60 secured to the outer faces of circular end flanges 58, with spindles 60 extending through aligned holes 54. Wing nuts 62 or the like are threaded onto spindles 60 in order to prevent rotation of reel 56 within reel brackets 52 when wing nuts 62 are tightened, and to permit free rotation of reel 56 within reel brackets 52 when wing nuts 62 are loosened.

A rope 64 which is not degradable in salt water, is wrapped about reel 56. In order to aid in the orderly pay of rope 64 from reel 56, a U-shaped elongated bar guide 66 is rotatably mounted on spindles 60 and has an elongated slot (not shown) in the center leg of elongated bar guide 66, through which rope 64 extends from reel 56. A conventional inflatable lift bag 70 is secured to the free end of rope 64 that extends through the slot of elongated bar guide 66. Lift bag 70 is an inflatable structure which can be inflated from the diver's tanks while under water, as is conventional.

It is noted that, with release clasps 50 within eyelets 40, as aforementioned, reel 56 is positioned at the abdomen level of the diver, and short strap 42 is then releasably secured about reel 56, whereby safe ascent/decompression device 10 is releasably held on diving harness 12 in front of the torso of the diver.

A fabric casing 72 is secured on back frame 48, immediately above reel 56. Fabric casing 72 includes a rear wall 74 fixedly secured to the rear of back frame 48, and four side walls 76, 78, 80 and 82 which define an enclosure 84. As shown best in FIG. 6, fabric casing 72 further includes a partial dividing wall 86 formed by elastic straps 88 connected across the front of back frame 48, and which divides enclosure 84 into a rear compartment 90 behind straps 88 and a forward compartment 92 (FIG. 5) in front of straps 88. In addition, four closure flaps 94, 96, 98 and 100 are secured to the forward edges of side walls 76, 78, 80 and 82, respectively. Securing means 102 are provided on the four closure flaps 94, 96, 98 and 100 for releasably securing opposite closure flaps in a sealing relation to each other so as to close enclosure 84. Preferably, securing means 102 includes small loops on one closure flap and small hooks on the opposite closure flap, so as to form a sealing arrangement commonly sold under the trademark "VELCRO".

Figure 6:
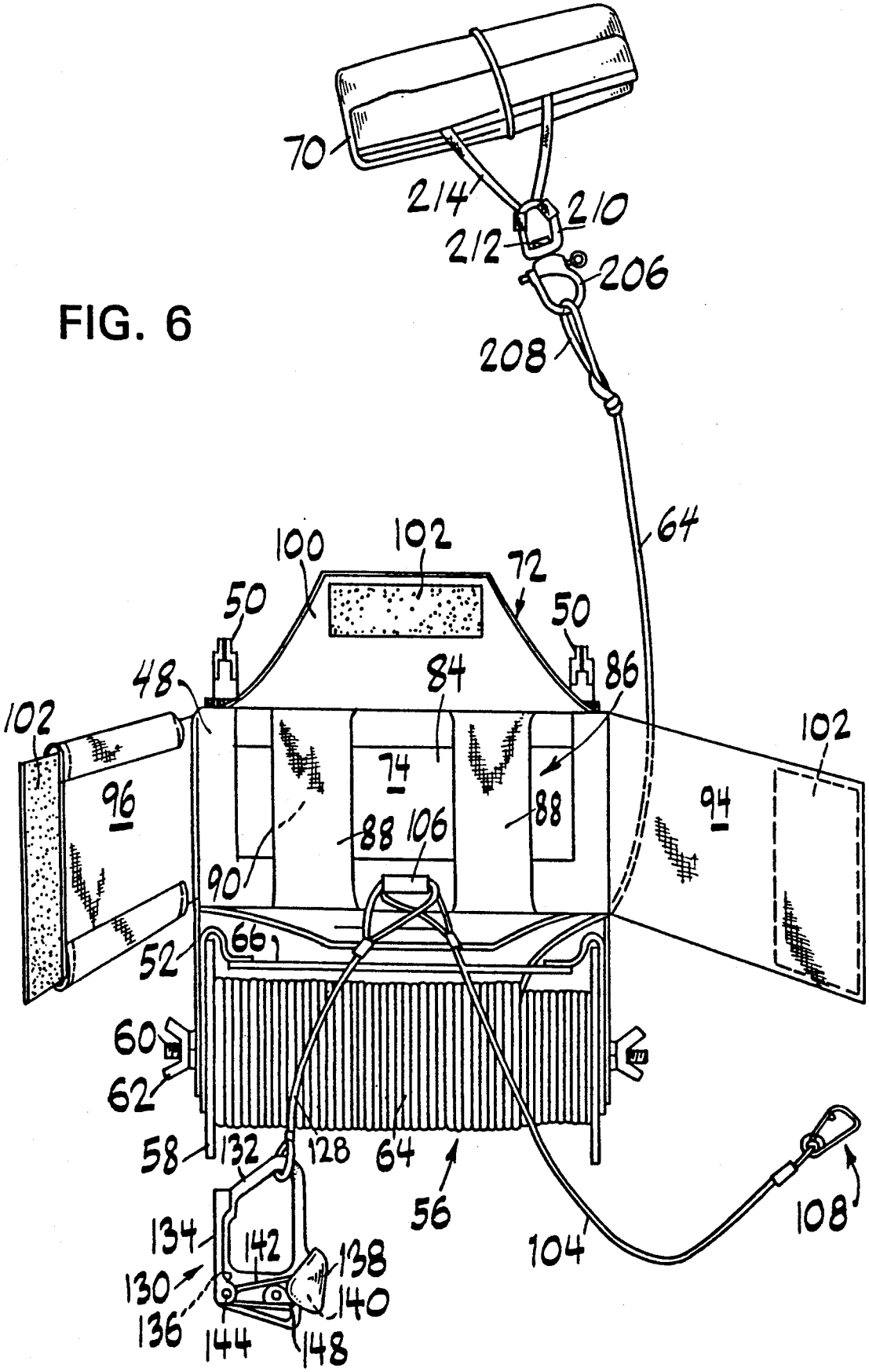
FIG. 6 is a front elevational view of the safe ascent-/decompression device of FIG. 2, in a fully opened configuration.

As shown in FIG. 6, a wire cable 104, which is approximately two feet long, is secured to a fabric tab 106 or other securing means at rear wall 74 of fabric casing 72 and within rear compartment 90. A release clip 108 is secured to the opposite free end of wire cable 104. Wire cable 104 and release clip 108 are removably held within rear compartment 90 by elastic straps 88 in a storage position. It is noted that lift bag 70 is stored in forward compartment 92 in front of elastic straps 88.

Figure 10:
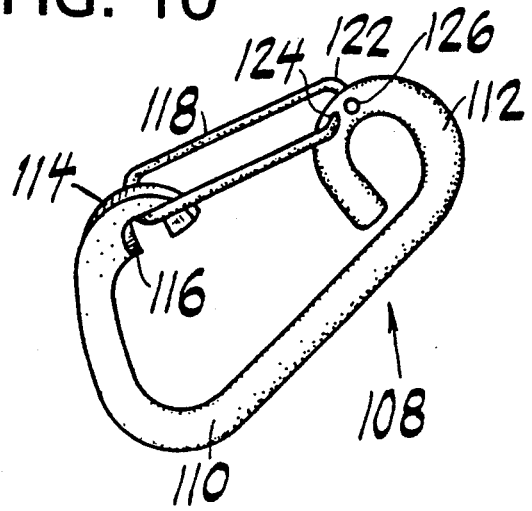
FIG. 10 is a perspective view of the small release clip shown in FIG. 6.

As shown best in FIGS. 6 and 10, release clip 108, which is commercially available, is formed in a substantially triangular configuration, with wire cable 104 being secured to one apex thereof. Specifically, two legs of the triangular configuration are formed from a bent metal piece 110. One end of bent metal piece 110 is formed into a loop 112, while the opposite end 114 of bent metal piece 110 is inturned and includes a depression 116 therein. Wire cable 104 is secured within loop 112. The third leg is formed by an elongated metal loop 118 pivotally connected to loop 112. More particularly, one end of elongated metal loop 118 is cut so as to present two oppositely facing free ends 120 and 122. One free end 120 is inserted within a hole 124 in loop 112. The other free end 122 is inserted within a hole 126 in loop 112, which is offset from hole 124. Because of the offset relation of holes 124 and 126, elongated metal loop 118 is spring biased such that the opposite end thereof is biased into depression 116.

Figure 12:
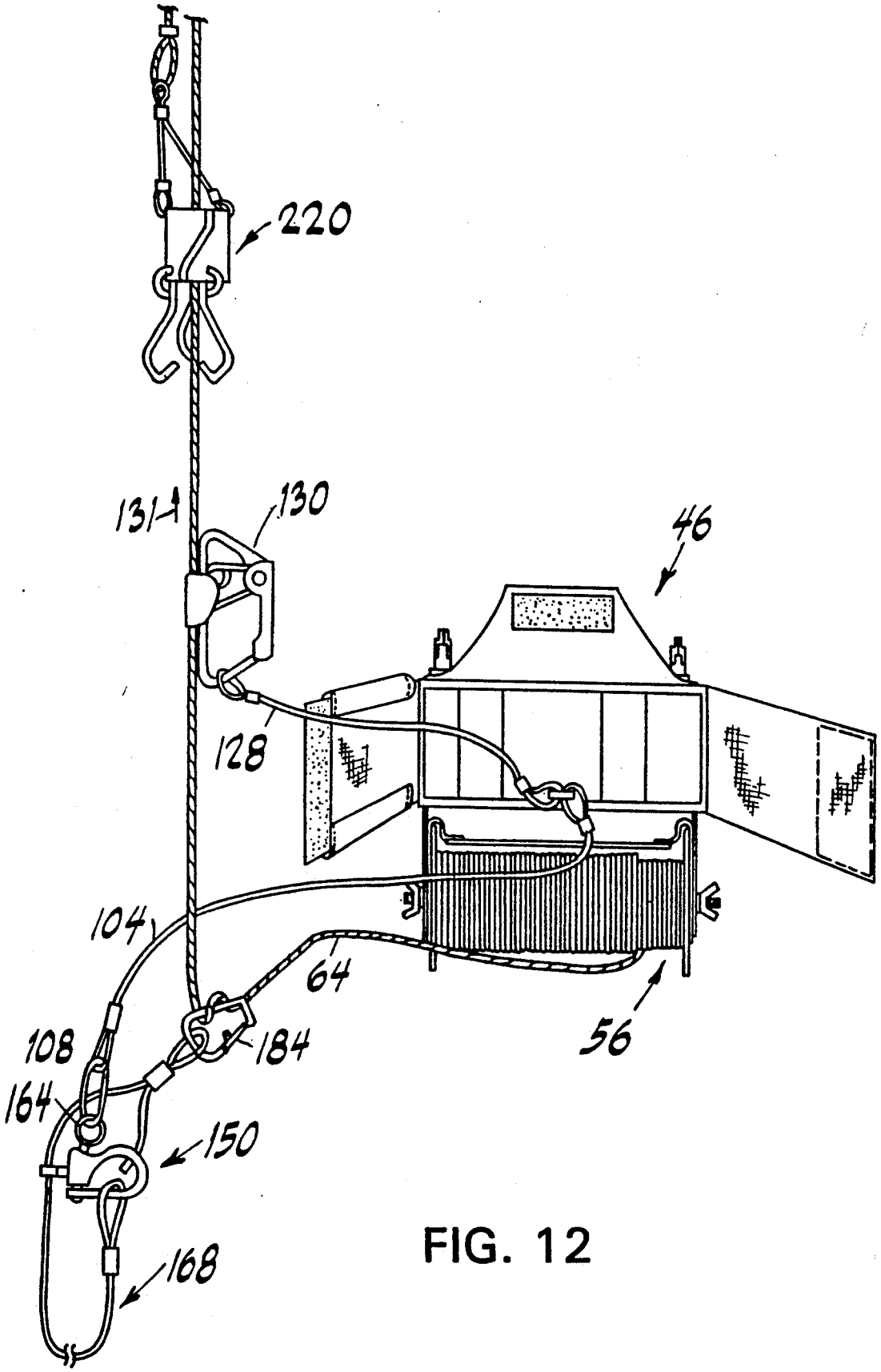
FIG. 12 is an elevational view of the safe ascent-/decompression device of FIG. 1, shown in use in the second mode of operation.

In addition, a wire cable 128 which is approximately six inches long, is secured to fabric tab 106 or other securing means at rear wall 74 of fabric casing 72 and is held within rear compartment 90 by elastic straps 88 in the storage position thereof. An ascender 130, which is commonly used in rock climbing, is secured to the opposite free end of wire cable 128. Ascender 130 includes a substantially trapezoidal-shaped metal frame 132, with an L-shaped bottom wall 134 extending from the shorter edge thereof and defining a lower channel 136 therewith, and a U-shaped top wall 138 extending from the longer edge thereof and defining an upper channel 140. A finger actuated release clamp 142 is pivotally mounted by a pivot pin 144 within lower channel 136, with pivot pin 144 extending between metal frame 132 and L-shaped bottom wall 134. Release clamp 142 is biased by a coil spring (not shown) that is wrapped about pivot pin 144, to force a roughened edge 148 of release clamp 142 against U-shaped top wall 138 in order to capture rope 64 therebetween. In this manner, release clamp 142 only permits travel of rope 64 in one direction, that is, ascender 130 can only travel along rope 64 in the direction of arrow 131 in FIG. 12, but is prevented from moving along rope 64 in the opposite direction.

In accordance with an important aspect of the present invention, a snap shackle 150 is provided. Snap shackle 150 is of a conventional nature, and includes a substantially U-shaped metal section 152 having a thickened end 154, and a closure lever 156 pivotally connected to the opposite end 158 of U-shaped metal section 152 by a pivot pin 157. The free end of closure lever 156 is formed with an inclined bore hole 160 therethrough. The thickened end 154 of U-shaped metal section 152 is formed with an inclined spring-loaded pin 162 which is biased outwardly toward the free end of closure lever 156, and thereby, into bore hole 160. The spring (not shown) is positioned about pin 162 within thickened end 154. Because of the inclination of bore hole 160 and spring-loaded pin 162, the free end of closure lever 156 is captured by spring-loaded pin 162 and cannot be pivoted away from metal section 152, but rather, is held thereto. To disengage spring-loaded pin 162 from bore hole 160 in order to permit opening of closure lever 156, a pull ring 164 is connected to the opposite end of spring-loaded pin 162. Thus, when pull ring 164 is pulled away from snap shackle 150, pin 162 becomes disengaged from bore hole 160, whereby closure lever 156 can be pivoted to an open position.

A short stub shaft 166 is fixed to thickened end 154. A wire cable 168 which is approximately five feet long, has one end 170 fixed through metal section 152. For example, end 170 extends through a bore 171 in metal section 152 and is capped at the inside of metal section 152 with an enlarged head 172.

A portion of wire cable 168 adjacent metal section 152 is bent and secured by a band 174 to form a small loop 176. Wire cable 168 extends from band 174 and is fixed to stub shaft 166, and thereafter extends freely away from stub shaft 166. It will be appreciated that the portion of wire cable 168 that is connected to metal section 152 and stub shaft 166 is a small length of wire cable. Therefore, approximately 4½ feet of wire cable 168 extends from the connection to stub shaft 166. The opposite end 178 of wire cable 166 is bent over itself and secured by a band 180 to form a fastening loop 182.

Figure 11:
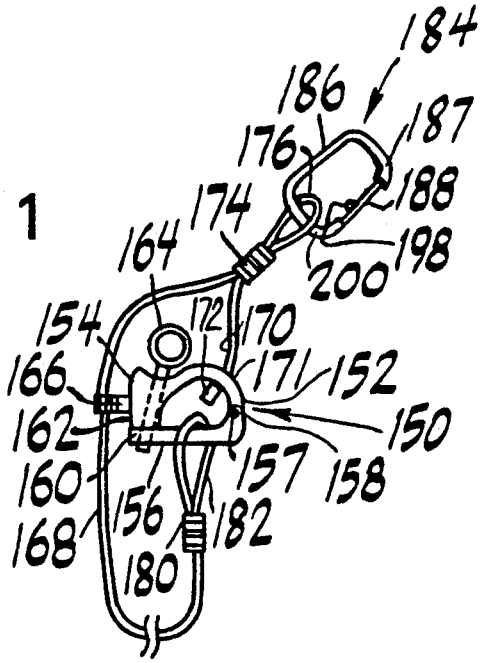
FIG. 11 is a side elevational view of the snap shackle, wire cable and large release clip for securement to a ship wreck during the ascent/decompression operation.

A large release clip 184, which is commercially available, is formed in a substantially rectangular configuration, and is constructed substantially identical to release clip 108. Specifically, release clip 184 is formed from a bent metal piece 186 which is open at one longer side of the rectangular configuration. The one longer side is closed by an elongated metal loop 188 pivotally connected to an open end 187 of bent metal piece 186. As with smaller release clip 108, one end of elongated metal loop 188 is cut so as to present two oppositely, facing free ends, only one of which is shown in FIG. 11.

One free end is inserted within a first hole in open end 187. The other free end is inserted within a second hole in open end 187, which is offset from the first hole, in the same manner as in smaller release clip 108. Because of the offset relation of the first and second holes, elongated metal loop 188 is spring biased such that the opposite end thereof is biased into a depression 198 at the opposite open end 200 of bent metal piece 186.

It is noted that the second folded side wall 78 of fabric casing 72 contains a first pocket 202 (FIG. 4) on its outer surface in which large release clip 184 is stored, and a second larger pocket 204 (FIG. 4) is provided on the outer surface of the corresponding closure flap 96 for storing snap shackle 150 and wire cable 168.

As a further note, the end of rope 64 can be connected to lift bag 70 in any suitable manner. As one example, a snap shackle 206 of identical construction to snap shackle 150 but of small dimensions thereof is connected to a loop 208 formed at the free end of rope 64, as shown in FIG. 6. A substantially rectangular metal hasp 210 is fixed to snap shackle 150 by a securing pin 212, and a strap 214 sewn to lift bag 70 is secured about hasp 210.

First Mode of Operation

In a first mode of operation, wire cable 168 is wrapped about something on the sunken ship and fastening loop 182 is placed over metal section 152 of snap shackle 150 in its open configuration. Then, spring-loaded pin 162 is pulled outwardly and closure lever 156 is pivoted to a closed position, whereupon pin 162 is released. As a result, pin 162 is biased into inclined bore hole 160 such that fastening loop 182 is caught in snap shackle 150, in the manner shown in FIG. 11.

Then, the diver inserts a portion of rope 64 which extends between lift bag 70 and reel 56, within large release clip 184. This is accomplished by biasing elongated metal loop 188 to an inwardly open position, and slipping rope 64 therein. Rope 64 is wrapped about a leg of bent metal piece 186 a couple of times in a serpentine fashion. Thereupon, elongated metal loop 188 is released and is automatically spring biased into its closing relation to prevent escape of rope 64 therein.

Thereafter, lift bag 70 is inflated by the diver to its maximum capacity, which is generally 100 pounds of pressure. Because lift bag 70 is at the end of rope 64, and because of the serpentine manner of wrapping rope 64, the diver can prevent ascent of lift bag 70, even when it is at its maximum 100 pounds of inflation, by merely pressing rope 64 against bent metal piece 186 by the diver's thumb. This manner of supporting and controlling large amounts of weight with a rope is well known from rock climbing.

When lift bag 70 is fully inflated, it is released, whereupon the diver, by means of thumb pressure, can regulate the ascent of lift bag 70 to the surface of the water. During this time, rope 64 pays out from reel 56. Because large release clip 184 is connected with wire cable 168, which is anchored to the wreckage, there is no need to worry about buoyancy of the diver.

After lift bag 70 has ascended to the surface of the water, the diver pulls a leader portion of rope 64 extending between large release clip 184 and reel 56, and ties off a first leader line to bent metal piece 186 of large release clip 184. The tying off of the first leader line can be made with any suitable knot or knots, as long as the knots are tight with no possibility of slippage and/or release. For example, conventional knots that can be used are clove hitch knots and half hitch knots.

Thereafter, the diver pulls another leader portion of rope 64 extending between reel 56 and the first leader line, and ties off a second leader line to pull ring 164 in the same manner.

The diver then proceeds up rope 64, by use of ascender 130 which the diver secures on rope 64 and manipulates to move upwardly, leading to lift bag 70, in a planned decompression, that is, stopping for predetermined periods of time at various stops. At this time, bag pack 46 is still secured to diving harness 12, and thereby travels upwardly with the diver. It will be appreciated that because lift bag 70 is connected through rope 64 and the other described elements so as to be tied to the ship wreck, there is no problem with current taking the diver far away from his boat. Accordingly, when the diver reaches the surface, he is very close to his boat.

During this ascent, rope 64 pays out from reel 56, since the second leader line is secured to pull ring 164 and the first leader line is secured to bent metal piece 186 of large release clip 184. Because the second leader line is secured to pull ring 164, when the diver reaches the surface, he gives a short snap on rope 64 extending from reel 56. This causes spring-loaded pin 162 to release from inclined bore hole 160, thereby causing closure lever 156 to pivot outwardly and openly. Therefore, fastening loop 182 of wire cable 168 is no longer restrained by snap shackle 150. Accordingly, continued pulling up of rope 64 extending from reel 56, causes snap shackle 150, wire cable 168 and large release clip 184 to be pulled upwardly therewith, in order to obtain full recovery of all equipment.

Alternatively, the diver can unhook bag pack 46 from diving harness 12 by means of release clasps 50. It will be appreciated that bag pack 46 weighs about eleven pounds. Therefore, since bag pack 46 is secured by the first leader line to large release clip 184, by the second leader line to pull ring 164 and to ascender 130 by wire cable 70, bag pack 46 floats in the water adjacent thereto.

Thereafter, the diver proceeds up rope 64, by use of ascender 130 which the diver manipulates to move upwardly, leading to lift bag 70, in a planned decompression, that is, stopping for predetermined periods of time at various stops.

During this time, bag pack 46 is carried upwardly because it is connected to ascender 130, but is not secured to harness 12. Accordingly, rope 64 from reel 56 pays out, since the first leader line is secured to large release clip 184 and the second leader line is secured to pull ring 164. Therefore, when the diver reaches the surface, he gives a short snap on rope 64 extending from reel 56 and recovers the equipment in the same manner as discussed above.

The above first mode of operation is easy and reliable when there is only a small current. However, when the current is large, great skill must be used in the first mode of operation. This is because if rope 64 extending from reel 56 to spring-loaded pin 162 is too slack, the high current will cause a large bow in the line, which will make it difficult to control. On the other hand, if the diver, to compensate, maintains the line too taut, it is possible that pin 162 will release too soon, thereby causing great difficulty for the diver in returning to the surface in the planned decompression.

Second Mode of Operation

Therefore, when there is a large current, it is preferable to use a second mode of operation, which only varies slightly from the first mode of operation.

Specifically, wire cable 168 is wrapped about something on the sunken wreck and fastening loop 182 is placed over metal section 152 of snap shackle 150. Then, spring-loaded pin 162 is pulled outwardly and closure lever 156 is pivoted to a closed position, whereupon pin 162 is released. As a result, pin 162 is biased into inclined bore hole 160 such that fastening loop 182 is caught in snap shackle 150.

Then, the diver inserts a portion of rope 64 which extends between lift bag 70 and reel 56, within large release clip 184. This is accomplished by biasing elongated metal loop 188 to an inwardly open position, and slipping rope 64 therein. Rope 64 is wrapped about a leg of bent metal piece 186 a couple of times in a serpentine fashion. Thereupon, elongated metal loop 188 is released and is automatically spring biased into its closing relation to prevent escape of rope 64 therein.

Thereafter, lift bag 70 is inflated by the diver to its maximum capacity, which is generally 100 pounds of pressure. Because lift bag 70 is at the end of rope 64, and because of the serpentine manner of wrapping rope 64, the diver can prevent ascent of lift bag 70, even when it is at its maximum 100 pounds of inflation, by merely pressing rope 64 against bent metal piece 186 by the diver's thumb. This manner of supporting and controlling large amounts of weight with a rope is well known from rock climbing.

When lift bag 70 is fully inflated, it is released, whereupon the diver, by means of thumb pressure, can regulate the ascent of lift bag 70 to the surface of the water. During this time, rope 64 pays out from reel 56.

After lift bag 70 has ascended to the surface of the water, the diver pulls a leader portion of rope 64 extending between large release clip 184 and reel 56, and ties off a first leader line to bent metal piece 186 of large release clip 184. The tying off of the first leader line can be made with any suitable knot or knots, as long as the knots are tight with no possibility of slippage and/or release. For example, conventional knots that can be used are clove hitch knots and half hitch knots.

The above operations are the same as in the first mode of operation.

Thereafter, the diver attaches ascender 130 to rope 64, attaches release clip 108 to pull ring 164, and then releases bag pack 46 from harness 12 by means of release clasps 50. It will be appreciated that bag pack 46 weighs about eleven pounds. Therefore, since bag pack 46 is secured by the first leader line to large release clip 184 and to rope 64 via ascender 130 and wire cable 128, bag pack 46 floats in the water adjacent thereto. In this case, ascender 130 is not used to ascend.

The diver then proceeds up rope 64, leading to lift bag 70, in a planned decompression, that is, stopping for predetermined periods of time at various stops. It will be appreciated that because lift bag 70 is connected through rope 64 and the other described elements so as to be tied to the ship wreck, there is no problem with current taking the diver far away from his boat. Accordingly, when the diver reaches the surface, he is very close to his boat. Further, rope 64 can be kept taut since it is prevented from pulling pull ring 164. In other words, pull ring 164 is not connected directly with rope 64, as with the second leader line in the first embodiment.

The diver therefore swims to his boat and removes most of the diving equipment. The diver then returns to lift bag 70, along with a spider clamp 220, as shown in FIGS. 7–9, which includes a cylindrical base 222 with a substantially expanded Z-shaped slit 224 extending along the entire length thereof. Z-shaped slit 224 permits rope 64 to enter within cylindrical base 222, and be captured therein. A plurality of, for example, three or four, L-shaped spider hooks 226 are pivotally secured to the lower end of cylindrical base 222 in a substantially equidistant arrangement. Thus, each spider hook 226 includes a securing leg 228 and a hook end 230.

Specifically, the lower end of cylindrical base 222 includes a plurality of holes 232 therein. The free end of securing leg 228 of each spider hook 226 extends through a respective hole 232 and is bent or looped therein so as to retain each spider hook 226 to cylindrical base 222 in a pivotal manner.

Finally, an eyelet 234 is secured to the upper end of cylindrical base 222 by wires 235, and the diver has one end of a long rope 236 secured to eyelet 234.

The diver therefore inserts rope 64 at the surface through Z-shaped slit 224, and therefore, within cylindrical base 222. Accordingly, when spider clamp 220 is released by the diver, spider clamp 220 slides down along rope 64. Of course, since spider clamp 220 is secured to rope 236, the diver controls the rate of descent of spider clamp 220 along rope 64.

When spider clamp 220 reaches ascender 130, the diver manipulates spider clamp 220 up and down until at least one hook end 230 engages with metal frame 132 of ascender 130. At such time, the diver pulls up on rope 236 so as to pull spider clamp 220 and ascender 130 which is hooked thereto, upwardly along rope 64. Because ascender 130 is connected to bag pack 46 by means of wire cable 128 and because release clip 108 is connected to bag pack 46 by wire cable 104, this upward movement of ascender 130 causes pin 162 to release from inclined bore hole 160, thereby causing closure lever 156 to pivot outwardly and openly. Therefore, fastening loop 182 of wire cable 168 is no longer restrained by snap shackle 150. Accordingly, continued pulling up of rope 64 extending from reel 56, causes snap shackle 150, wire cable 168, large release clip 184 and bag pack 46 to be pulled upwardly therewith, in order to obtain full recovery of all equipment by continued pulling upwardly of rope 236 and spider clamp 220.

Therefore, with the present invention, a safe ascent-/decompression device is provided that can be easily retrieved after use. As a result, a stronger, lighter and thinner decompression line that will not decompose in salt water can be used.

Further, with the present invention, the diver can inflate the lift bag to its full capacity at the start of the ascent operation, and need not partially deflate his wet suit for buoyancy at the start of an ascent operation.

Still further, the safe ascent/decompression device according to the present invention is smaller and can be carried in a smaller area at the front of the diver's torso.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. An ascent/decompression device for use in diving with an inflatable lift bag, said device comprising:

pack means for securing said ascent/decompression device on a diving harness worn by a diver;

a reel having a decompression line wound thereabout, said reel being mounted for rotation to said pack means, and said decompression line having a free end connected to the inflatable lift bag;

a cable;

releasable cable securement means for releasably securing said cable about a ship wreck;

first release clip means for receiving said decompression line and for limiting a rate of ascent of said lift bag connected to said decompression line, said first release clip means being connected to one of said cable and said releasable cable securement means; and ascender means for grabbing onto and moving along said decompression line, said ascender means including direction limiting means for limiting a direction of movement of said ascender means along said decompression line, said ascender means being connected to one of said pack means and said harness.

2. An ascent/decompression device according to claim 1, wherein said releasable cable securement means includes release engagement means engageable with a portion of said decompression line such that a pulling force on said decompression line when the diver is at a surface of a body of water will cause said releasable cable securement means to release said cable from securement about the ship wreck.

3. An ascent/decompression device according to claim 1, wherein said cable has a first end and a second end, with said second end formed into a loop, and said releasable cable securement means includes snap shackle means for releasably holding said loop.

4. An ascent/decompression device according to claim 3, wherein said snap shackle means includes:

a main section having an open side, said first end of said cable being connected with said main section, closure lever means pivotally connected to said main section for movement between a closed position in closing relation to said open side and an open position which permits access to said open side, and releasable locking means for releasably locking said closure lever means in said closed position in order to capture said loop therein.

5. An ascent/decompression device according to claim 4, wherein said releasable locking means includes:

an inclined bore hole in a free end of said closure lever means;

spring-biased pin means in said main section for normally engaging within said inclined bore hole to lock said closure lever means in said closed position; and pull means connected with said spring-biased pin means for moving said spring-biased pin means out of engagement with said inclined bore hole to permit pivoting of said closure lever means to said open position, wherein said cable is formed into a closed configuration when said loop of said cable is releasably held within said snap shackle means so that said cable can be releasably secured about the ship wreck.

6. An ascent/decompression device according to claim 5, further including second release clip means for engaging with said pull means of said releasable cable locking means, and tying cable means for connecting said second release clip means to said pack means.

7. An ascent/decompression device according to claim 1, wherein said first release clip means is connected to said releasable cable securement means through a portion of said cable.

8. An ascent/decompression device according to claim 1, wherein said first release clip means includes:

a main section having an open side; and biased closure lever means pivotally connected to said main section for movement between a closed position in closing relation to said open side and an open position which permits insertion and removal of said decompression line through said open side, said closure lever means normally being biased into said closed position.

9. An ascent/decompression device according to claim 1, further including spider means for riding along a section of said decompression line extending between the lift bag when inflated and said reel, and for grabbing said ascender means; and pull line means connected with said spider means for pulling said ascender means upwardly along said section of said decompression line.

10. An ascent/decompression device according to claim 9, wherein said spider means includes cylinder means for receiving said decompression line therein and for riding along said section of said decompression line, said cylinder means being connected with said pull line means, and hook means connected with said cylinder means for grabbing said ascender means.

11. An ascent/decompression device according to claim 10, wherein said cylinder means includes a slit along the entire length thereof for insertion of said decompression line into said cylinder means, and said hook means includes a plurality of hooks pivotally mounted on said cylinder means.

12. An ascent/decompression device according to claim 1, wherein said pack means includes clasp means for releasably securing said pack means to a diving harness worn by the diver.

13. An ascent/decompression device for use in diving with an inflatable lift bag, said device comprising:

pack means for securing said ascent/decompression device on a diving harness worn by a diver, said pack means including clasp means for releasably securing said pack means to the diving harness worn by the diver;

a reel having a decompression line wound thereabout, said reel being mounted for rotation to said pack means, and said decompression line having a free end connected to the inflatable lift bag;

a cable having a first end and a second end, with said second end formed into a loop;

releasable cable securement means for releasably securing said cable about a ship wreck, said releasable cable securement means including snap shackle means for releasably holding said loop of said cable, said snap shackle means including:

a main section having an open side, said first end of said cable being connected with said main section, closure lever means pivotally connected to said main section for movement between a closed position in closing relation to said open side and an open position which permits access to said open side, and releasable locking means for releasably locking said closure lever means in said closed position;

first release clip means for receiving said decompression line and for limiting a rate of ascent of said lift bag connected to said decompression line, said first release clip means being connected to one of said cable and said releasable cable securement means;

second release clip means for engaging with said releasable locking means of said snap shackle means, and tying cable means for connecting said second release clip means to said pack means;

ascender means for grabbing onto and moving along said rope, said ascender means including direction limiting means for limiting a direction of movement of said ascender means along said rope, said ascender means being connected to one of said pack means and said harness;

spider means for riding along a section of said decompression line extending between the lift bag when inflated and said reel, and for grabbing said ascender means, said spider means being connectable to pull line means for pulling said spider means, and thereby said ascender means, upwardly along said section of said decompression line.

14. An ascent/decompression device according to claim 13, wherein said releasable locking means includes:

an inclined bore hole in a free end of said closure lever means, spring-biased pin means in said main section for normally engaging within said inclined bore hole to lock said closure lever means in said closed position, and pull means connected with said spring-biased pin means for moving said spring-biased pin means out of engagement with said inclined bore hole to permit pivoting of said closure lever means to said open position, wherein said cable is formed into a closed configuration when said loop of said cable is releasably held within said snap shackle means so that said cable can be releasably secured about the ship wreck.

15. An ascent/decompression device according to claim 13, wherein said first release clip means is connected to said releasable cable securement means through a portion of said cable.

16. An ascent/decompression device according to claim 13, wherein said first release clip means includes:

a main section having an open side, and biased closure lever means pivotally connected to said main section for movement between a closed position in closing relation to said open side and an open position which permits insertion and removal of said decompression line through said open side, said closure lever means normally being biased into said closed position.

17. An ascent/decompression device according to claim 13, wherein said spider means includes cylinder means for receiving said decompression line therein and for riding along said section of said decompression line, said cylinder means being connected with said pull line means, and hook means connected with said cylinder means for grabbing said ascender means.

18. An ascent/decompression device according to claim 17, wherein said cylinder means includes a slit along the entire length thereof for insertion of said decompression line into said cylinder means, and said hook means includes a plurality of hooks pivotally mounted on said cylinder means.

* * * * *